United States Patent [19]

Swenson

[11] Patent Number: 4,928,842

[45] Date of Patent: May 29, 1990

[54] DEVICE FOR STOPPING THE SPILLAGE OF POPCORN

[76] Inventor: Julius A. Swenson, 4209 Sandwood Dr., Columbia, S.C. 29206

[21] Appl. No.: 407,815

[22] Filed: Sep. 15, 1989

[51] Int. Cl.[5] ..... A47J 43/00

[52] U.S. Cl. ..... 220/85 R; 220/90.4; 220/83

[58] Field of Search ..... 220/85 R, 83, 90.4, 220/DIG. 13

[56] References Cited

U.S. PATENT DOCUMENTS

| | | | |
|---|---|---|---|
| 105,991 | 8/1870 | Smith | 220/83 |
| 879,364 | 2/1908 | Cohen | 220/83 |
| 2,362,354 | 11/1944 | Clovis | 220/90.4 |
| 2,617,280 | 11/1952 | Anderson | 220/85 R X |
| 2,683,974 | 7/1954 | Brown | 220/85 R X |
| 3,940,012 | 2/1976 | Addington | 220/90.4 |
| 4,116,355 | 9/1978 | Munn et al. | 220/85 R X |
| 4,322,008 | 3/1982 | Schneider | 220/85 R X |

*Primary Examiner*—Steven M. Pollard
*Attorney, Agent, or Firm*—Michael A. Mann

[57] ABSTRACT

Device for use in serving popcorn and the like comprising a vertical member secured to the generally concave interior surface of a container. The vertical member has an irregular exterior surface stopping the spilling of popcorn when a hand reaches into the container for popcorn. Preferably the vertical member has six to eight fluted sides and a smaller cross section at its middle than its ends. Alternatively, the vertical member is integrated into the bowl.

5 Claims, 1 Drawing Sheet

PRIOR ART
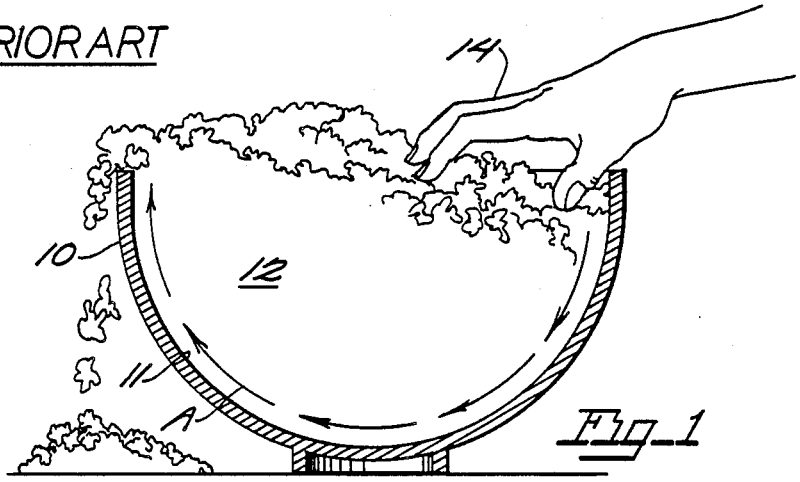
Fig. 1
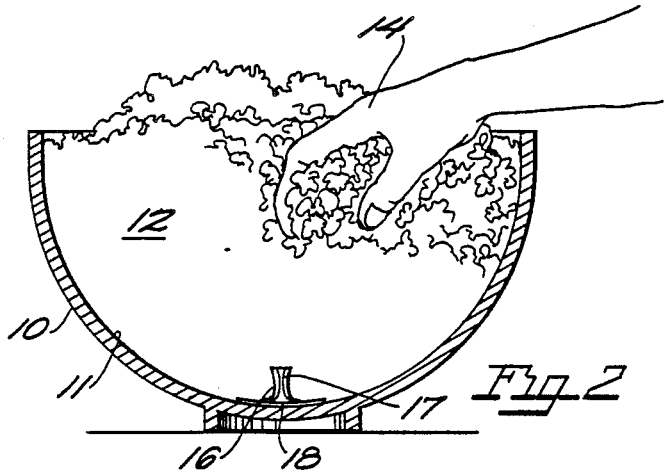
Fig. 2
Fig. 3
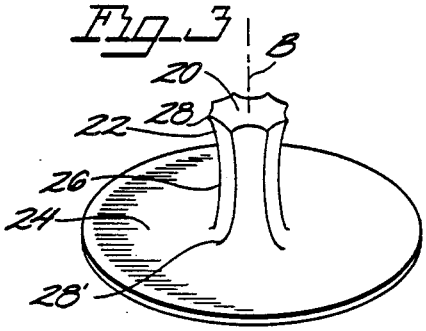
Fig. 4
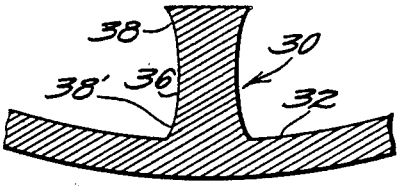

DEVICE FOR STOPPING THE SPILLAGE OF POPCORN

BACKGROUND

1. Field of the Invention

The present invention relates to devices for serving popcorn. In particular, the present invention relates to devices for stopping the spillage of popcorn from a container when one reaches into said container for a handful of popcorn.

2. Discussion of Background

Popcorn is frequently served in bowls having a generally concave interior. Those who have eaten popcorn know the difficulty of getting a handful of popcorn without spilling some from the bowl. By its nature, popcorn is light and airy and moves without much resistance when pressure is applied. Furthermore, the popped kernels tend to interlock and move together so that, when one attempts to reach into one side of a bowl, the corn will be pushed lockstep from the other side of the bowl. There is a need for a means for stopping the spillage of the popcorn served in a bowl.

SUMMARY OF THE INVENTION

According to its major aspects, the present invention comprises a vertical member and a means for securing the vertical member to the interior of a bowl. The vertical member preferably has an irregular exterior surface to catch popcorn and may be multi-sided, preferably with fluted sides and most preferably having a smaller cross section at its midpoint than at its ends. The means for securing the vertical member to the interior of the bowl is a suction cup or a flange attached to the vertical member made of a high friction material, such as soft rubber to frictionally engage the interior of the bowl.

Alternatively the device can be incorporated into a bowl made of plastic, metal, wood or ceramic.

It is a feature of the present invention that the device can be small with respect to the bowl, such as approximately one inch in height and less than an inch in diameter, yet still stop the spillage of the contents of a large bowl of popcorn. Because popcorn kernels tend to interlock, stopping a few stops many. The advantage of this feature is that the device takes up little space in the bowl room and does not subtract significantly from the interior volume bowl.

It is another feature of the present invention in its preferred embodiment that the exterior sides of the vertical member are concave and fluted to better catch and hold the popcorn kernels.

These and other features and advantages of the present invention will be apparent to someone skilled in the art from a careful reading of the following description and a review of the drawings.

BRIEF DESCRIPTION OF THE DRAWINGS

The accompanying drawings, which are incorporated in and form a part of the specification, illustrate the invention and, together with the description, serve to explain the principles of the invention. In the drawings:

FIG. 1 is a cross sectional side view of a prior art container of popcorn into which a hand is reaching, thereby causing spilling of popcorn ;

FIG. 2 is a cross sectional side view of a container of popcorn according to the present invention;

FIG. 3 is a perspective view of a device according to the present invention; and FIG. 4 is a partial cross sectional view of a bowl according to the present invention.

DETAILED DESCRIPTION OF A PREFERRED EMBODIMENT

The present invention is a device for use in serving popcorn and the like. Other like-weight items placed in bowls and removed a portion at a time may also be used with the present invention.

Referring now to FIG. 1 showing the prior art, a bowl or container 10 has a generally concave interior 11, typical of bowls used for serving popcorn. Container 10 is filled with popcorn. A hand 14 is shown reaching into container 10. Popcorn kernels, being light and tending to interlock, move generally together in a direction away from the hand, as indicated by arrows A. As hand 14 moves into container 10, popcorn 12 will spill from the side of container 12 opposite hand 14.

FIG. 2 illustrates an embodiment of the present invention wherein a device is releasably attached to container 10. In this embodiment, device 16 stops the movement of popcorn 12 as hand 14 reaches into container 10. Although device 16 may large compared to the size of container 10, it is preferably relatively small compared to container 10. It is important that device 16 be generally about the same size and preferably slightly larger than a popped kernel of corn. For example, device 16 can be approximately one inch in height and slightly less than one inch in diameter.

Device 16 has a vertical member 17 and a means for releasably securing vertical member 17 to an interior surface 11 of container 10. The securing means may be a suction cup or a flange 18 as shown in FIG. 2. Flange 18 is preferably made of a high friction material, most preferably soft rubber so that it adheres frictionally to interior 11 of container 10.

Device 16 as described in the present invention is shown in more detail in FIG. 3. Device 16 is composed of a vertical member 20 with a plurality of fluted sides 22 attached to flange 18. The vertical member 20 has a radius from axis B that is smaller at middle portion 26 than at the end portions 28, 28'. Device 16 is secured to interior surface 11 of container 10 and generally centered. Popcorn is then added to the container. When a hand reaches into the container having device 16, kernels of popcorn catch on sides 22. As popped corn tends to interlock, the catching of a few kernels causes popcorn to remain within container 10 rather than spill from the opposite side of the container.

FIG. 4 depicts a cross sectional view of the device generally indicated by the numeral 30 incorporated into and integral with a container 32. Device 30 has vertical portion 34 permanently attached to container 32. The radius of the middle portion 36 is smaller than the radius of the end portions 38,38'.

The device should have a sufficiently irregular exterior surface, preferably having several concave areas so that parts of popped corn kernels are "caught" within the concave areas. These surface irregularities may be found in a variety of forms for device 30 including figures of animals and people in miniature, perhaps with arms extended or in other geometric shapes. It is only necessary to stop a few kernels of popped corn to stop the major portion of the contents of container 10.

Those skilled in the art having the benefit of the teachings of the present invention as hereinabove set forth may effect numerous modifications thereto, These modifications are to be construed as lying within the contemplation and scope of the present invention as defined by the appended claims.

What is claimed is:

1. A device for serving popcorn, comprising:

a container with a generally concave interior;

a vertical member having an irregular exterior surface attached to the interior surface of said container at approximately the center thereof;

said vertical member having a cross-section that is smaller in the middle than at the ends;

said vertical member irregular surface comprising a plurality of fluted sides;

whereby during removal of the popcorn from the container, the popped kernals tend to interlock with each other and against the vertical member, thus causing the popcorn to remain in the container rather than spill from the opposite side of the container.

2. The device of claim 1, wherein said vertical member has a flange at the lower end thereof, said flange being made of a high friction material.

3. The device of claim 2, wherein said flange is made of soft rubber.

4. The device of claim 1, wherein said vertical member has a suction cup at the lower end thereof.

5. The device of claim 1, wherein said vertical member has six to eight fluted sides.

* * * * *